US010513846B2

(12) United States Patent
Heiland

(10) Patent No.: US 10,513,846 B2
(45) Date of Patent: Dec. 24, 2019

(54) ENVIRONMENTAL NOISE SHIELDING APPARATUS

(75) Inventor: Peter Heiland, Raunheim (DE)

(73) Assignee: INTEGRATED DYNAMICS ENGINEERING GMBH, Raunheim (DE)

( * ) Notice: Subject to any disclaimer, the term of this patent is extended or adjusted under 35 U.S.C. 154(b) by 365 days.

(21) Appl. No.: 11/855,057

(22) Filed: Sep. 13, 2007

(65) Prior Publication Data

US 2008/0067000 A1 Mar. 20, 2008

(30) Foreign Application Priority Data

Sep. 19, 2006 (EP) ..... 06019536
Oct. 30, 2006 (EP) ..... 06022659

(51) Int. Cl.
*H05K 7/20* (2006.01)
*E04B 1/82* (2006.01)
*F24F 13/24* (2006.01)

(52) U.S. Cl.
CPC ..... *E04B 1/8218* (2013.01); *F24F 13/24* (2013.01)

(58) Field of Classification Search
CPC ..... H05K 7/20
USPC ..... 454/184, 206
See application file for complete search history.

(56) References Cited

U.S. PATENT DOCUMENTS 2,074,283 A * 3/1937 Stauber ..... A62B 13/00 165/45
3,194,023 A 7/1965 Sudmeier
3,708,977 A * 1/1973 Raymond ..... 60/453
3,977,492 A * 8/1976 Hankel ..... 181/292
5,666,239 A * 9/1997 Pottebaum ..... 360/99.23
5,960,638 A * 10/1999 McCabe et al. ..... 62/90
6,190,937 B1 * 2/2001 Nakagawa ..... C30B 19/12 257/E21.115
6,203,582 B1 * 3/2001 Berner ..... H01L 21/67173 29/25.01
6,450,288 B1 9/2002 Akiyama et al.
6,459,578 B1 * 10/2002 Wagner ..... 361/694
6,491,298 B1 * 12/2002 Criss-Puszkiewicz et al. ..... 273/148 R
6,557,374 B2 * 5/2003 Kotliar ..... A62C 3/0221 169/45

(Continued)

FOREIGN PATENT DOCUMENTS

DE 19858002 6/2000
EP 1 544 873 A2 12/2004

(Continued)

OTHER PUBLICATIONS

"European Office Action for European Application No. EP 06 22 659.4", dated Apr. 5, 2011, Publisher: European Patent Office, Published in: EP.

(Continued)

*Primary Examiner* — Steven B McAllister
*Assistant Examiner* — Samantha A Probst
(74) *Attorney, Agent, or Firm* — Kaplan Breyer Schwarz, LLP

(57) ABSTRACT

The invention relates to an environmental noise shielding apparatus in which the internal temperature can be matched to the external temperature by means of a cooling element which is arranged within the environmental noise shielding apparatus. This allows a better sound protection effect.

13 Claims, 6 Drawing Sheets

(56) References Cited

U.S. PATENT DOCUMENTS 6,747,872 B1* 6/2004 Patel et al. ..... 361/695
7,573,713 B2* 8/2009 Hoffman et al. ..... 361/697
7,699,691 B1* 4/2010 Voigt et al. ..... 454/184
7,724,515 B2* 5/2010 Fukuda et al. ..... 361/679.5
7,903,404 B2* 3/2011 Tozer ..... H05K 7/20827 165/104.21
8,379,383 B2* 2/2013 Sugiura ..... G06F 1/203 165/104.21
2001/0018325 A1* 8/2001 Adams ..... F24F 13/24 454/237
2003/0081381 A1* 5/2003 Moizer ..... H05K 7/20572 361/690
2003/0199245 A1* 10/2003 Akhtar ..... 454/262
2004/0007348 A1* 1/2004 Stoller ..... H02B 1/565 165/47
2004/0020224 A1* 2/2004 Bash ..... F25B 5/02 62/228.4
2004/0043722 A1* 3/2004 Richter ..... E04D 13/0354 454/358
2004/0110391 A1* 6/2004 Ahn ..... C23C 16/40 438/778
2004/0142654 A1* 7/2004 Stammer ..... F24F 7/00 454/357
2004/0163337 A1* 8/2004 Claerbout ..... E04H 9/10 52/167.1
2004/0264124 A1* 12/2004 Patel ..... H05K 7/20736 361/679.46
2004/0264133 A1* 12/2004 Fukuda ..... G11B 33/142 361/695
2005/0100728 A1* 5/2005 Ristic-Lehmann ..... A41D 19/01529 428/323
2005/0257554 A1* 11/2005 Yun et al. ..... 62/295
2005/0262868 A1* 12/2005 Jeong ..... E05F 1/1091 62/408
2006/0037815 A1 2/2006 Schabel, Jr.
2006/0064935 A1* 3/2006 Smith ..... E04F 17/12 49/381
2006/0070683 A1* 4/2006 Goeck ..... B60K 15/04 141/301
2006/0139877 A1* 6/2006 Germagian ..... H05K 7/20745 361/695
2007/0006798 A1* 1/2007 Vaartstra ..... C23C 16/40 117/86
2007/0058339 A1* 3/2007 Hoffman et al. ..... 361/688
2007/0297136 A1* 12/2007 Konshak ..... H05K 7/20772 361/699
2008/0057265 A1* 3/2008 Liang ..... B32B 5/02 428/114
2008/0113598 A1* 5/2008 Pucciani ..... F04D 29/663 454/56
2008/0266726 A1* 10/2008 Murakami ..... H05K 7/2079 361/1
2009/0016855 A1* 1/2009 Hofmeister ..... H01L 21/67126 414/220
2009/0216910 A1* 8/2009 Duchesneau ..... G06F 9/5072 709/250
2010/0171400 A1* 7/2010 Hill ..... H05K 7/20618 312/236
2010/0188833 A1* 7/2010 Liang ..... H01B 1/04 361/818
2012/0156981 A1* 6/2012 Curtin ..... H05K 7/20836 454/184
2013/0340361 A1* 12/2013 Rogers ..... H05K 7/20745 52/173.1
2015/0373868 A1* 12/2015 Elkins ..... F24F 7/04 454/184

FOREIGN PATENT DOCUMENTS

FR 1 583 923 A 12/1969
JP 58-63199 A 4/1983
JP 59073641 4/1984
JP 10300305 A 11/1998
KR 20010074381 A 8/2001

OTHER PUBLICATIONS

T. Chihiro, "JP Patent Application 2007-241707 Office Action", dated Jun. 8, 2009, Publisher: JPO, Published in: JP.
"Office Action", dated Sep. 9, 2015, Publisher: issued in related European Patent Application No. 06 022 659.4.
Matsushita Reiki, "Thermoelectric module type electric refrigerator . . . ", "Database WPI Week", Nov. 13, 1998, Publisher: Derwent Publications, Ltd., Published in: London, GB.

* cited by examiner

ENVIRONMENTAL NOISE SHIELDING APPARATUS

FIELD OF THE INVENTION

The invention relates to an environmental noise shielding apparatus, and to a method for shielding an appliance against environmental noise.

BACKGROUND TO THE INVENTION

Apparatuses for an acoustic shielding of sensitive appliances are known from practical use. So-called acoustic shrouds are used to shield sensitive inspection machines, particularly in the semiconductor industry.

A housing which provides sound attenuation such as this at the same time generally also provides heat isolation. Particularly when an appliance is incorporated in a housing which produces heat losses, significant temperature increases can therefore occur in the interior of the housing. In many cases, a temperature increase such as this is undesirable. Particularly when using a housing to isolate inspection appliances in the semiconductor industry, it is desirable for the interior of the sound protection shroud to be essentially at the same temperature as the external area in order, for example, to ensure that wafers which are introduced into the interior are not subject to temperature fluctuations. In practice, attempts have been made to reduce the heating of such sound protection shrouds by fans.

Fans such as these have the disadvantage that, even if they are fitted in a manner which in particular attenuates sound, an aperture opening is still also created for sound, thus reducing the sound isolation effect of the housing.

OBJECT OF THE INVENTION

In contrast, the invention is based on the object of providing an apparatus for protection of a sensitive appliance against environmental noise, in which the disadvantages mentioned with the prior art are reduced.

One particular object of the invention is to provide an apparatus which improves the sound protection effect.

A further object of the invention is to provide a sound protection apparatus in which the internal temperature can be kept at the same level as the external temperature.

SUMMARY OF THE INVENTION

The object of the invention is achieved just by an environmental noise shielding apparatus and by a method for shielding an appliance against environmental sound, as claimed in one of the independent claims.

Preferred embodiments and developments of the invention can be found in the respective dependent claims.

According to the invention, an environmental noise shielding apparatus is provided which has a housing which defines an area for holding an isolating appliance.

The expression an environmental noise shielding apparatus means an apparatus in which an appliance to be isolated can be arranged, and in which the noise volume is reduced by the housing of the apparatus, that is to say the sound level in the area for holding an appliance to be isolated is lower than in the surrounding area.

According to the invention, at least one cooling element is arranged in that area. A cooling element is any apparatus by means of which the area for holding the appliance to be isolated can be cooled.

In one preferred embodiment of the invention, the cooling element is coupled to at least one supply device, which is arranged outside the appliance. The supply device is preferably essentially decoupled from the housing, that is to say vibration of the supply device is not transmitted to the housing of the appliance to be isolated.

By way of example, compressor cooling elements, Peltier elements or cooling meander circuits can be used for cooling purposes, which are fitted to one or more points on the inner wall of the housing, or may be parts of the walls or of the lids.

The choice of the cooling element is in this case governed primarily by the requirements for the cooling power. Since the heat losses, particularly from inspection appliances in the semiconductor industry, are often quite low, Peltier elements or cooling meander circuits in which the heat is dissipated via a fluid, in particular water, are sufficient for many applications. A coolant compressor can also be used for applications in which the cooling power is greater.

Flexible lines, such as those provided for one particular embodiment of the invention, in this case ensure that vibration of the supply device, in particular vibration of a cooling compressor, is not passed on, or is passed on only to a minor extent, to the housing of the environmental noise shielding apparatus.

The cooling element in the housing of the environmental noise shielding apparatus is preferably designed such that it produces a sound level of less than 30 dB, preferably of less than 20 dB, and particularly preferably of less than 15 dB. Cooling elements are therefore used which produce little noise in the interior of the housing.

The cooling element or elements is or are preferably integrated in the wall or lid of the housing, in particular with provision being made for a cooling element to be accommodated essentially in the lid of the housing.

In one development of the invention, a temperature sensor is arranged in the area, and is designed to regulate a supply device for coolant. The temperature in the interior of the housing can be kept constant by using a temperature sensor such as this.

In one alternative embodiment, as is provided according to one development of the invention, a further temperature sensor is arranged outside the area, and can be used to measure the temperature outside the housing. The temperature in the area in the housing can thus be matched to the external temperature. Temperature fluctuations when closing sensitive appliances or components to be investigated in the environmental noise shielding apparatus are largely avoided.

In one development of the invention, the environmental noise shielding apparatus has at least one opening flap which, as provided in one preferred embodiment of the invention, can be operated automatically. For example, the environmental noise shielding apparatus can be integrated in an automatic transport system, in which, for example, samples to be investigated are moved by an automation device into the housing of the environmental noise shielding apparatus.

The area in the environmental noise shielding apparatus can preferably be closed in an essentially fluidtight manner. This increases the sound-isolating effect, and more accurate temperature regulation is possible.

The area preferably occupies a space of between 0.2 and 7 $m^3$, and particularly preferably between 0.5 and 1.5 $m^3$.

The invention makes it possible to provide environmental noise shielding apparatuses which have a sound attenuation at a frequency of 500 Hz and with an incidence angle which runs essentially at right angles to a housing wall of more than 5 dB, preferably of more than 10 dB, and particularly preferably of more than 40 dB.

The sound attenuation at a frequency of 250 Hz is more than 3 dB, preferably more than 8 dB, and particularly preferably more than 30 dB.

The sound attenuation at a frequency of 100 Hz is more than 15 dB, preferably more than 30 dB, and particularly preferably more than 50 dB.

The invention also relates to a vibration isolation system which has an environmental noise shielding apparatus according to the invention.

The environmental noise shielding apparatus is in this case preferably mounted in a vibration-isolated form, in particular with provision being made for the environmental noise shielding apparatus to be arranged on a vibration-isolated plate.

The invention also relates to a method for shielding an appliance against environmental sound, with an appliance to be shielded being introduced into a housing which is then closed, and with a cooling apparatus which is arranged in the housing being regulated by a sensor which is likewise arranged in the housing.

In one development of the invention, the temperature in the housing is matched to the temperature outside the housing by means of a further sensor which is arranged outside the housing.

BRIEF DESCRIPTION OF THE DRAWINGS

The invention will be explained in more detail in the following text using the drawings, FIG. 1 to FIG. 6, in which.

Figure 1:
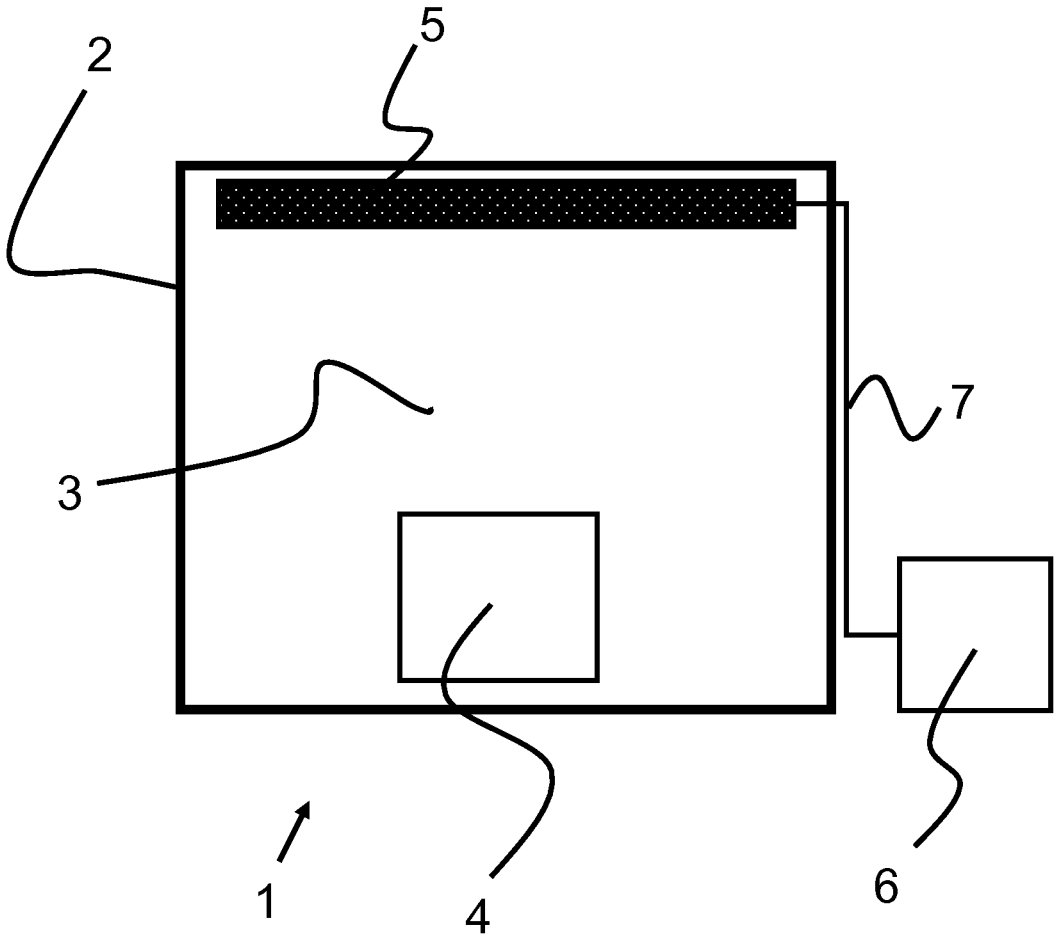
FIG. 1 shows, schematically, the major components of an environmental noise shielding apparatus.

The major components of an environmental noise shielding apparatus 1 will be explained in more detail with reference to FIG. 1. The environmental noise shielding apparatus 1 has a housing 2 to be isolated, which defines an area 3 for holding an appliance 4 to be isolated. A cooling element 5 is arranged in the area 3 of the environmental noise shielding apparatus 1 and is connected via a flexible supply line 7 to a supply device 6, in this case in the form of a coolant compressor. The cooling element 5 is cooled via the supply device 6, thus cooling the area 3 within which the appliance to be isolated is arranged.

Figure 2:
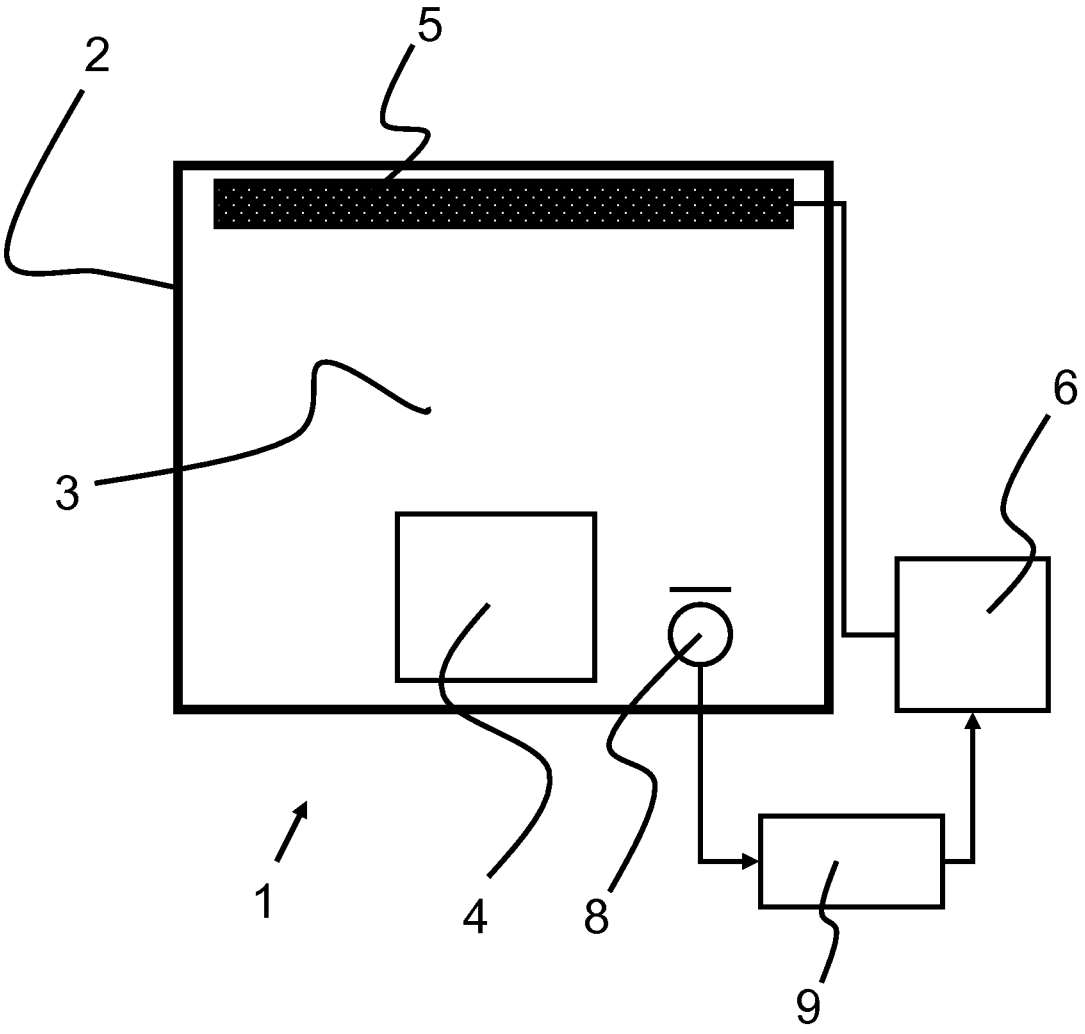
FIG. 2 shows, schematically, an alternative embodiment of an environmental noise shielding apparatus.

FIG. 2 shows an alternative embodiment of an environmental noise shielding apparatus 1, in which a temperature sensor 8 is arranged in the housing 2. The temperature sensor 8 is located in the vicinity of the appliance 4 to be isolated.

The temperature sensor 8 is connected to a control device 9 which drives the supply device 6. The temperature in the area 3 can be kept essentially constant by means of the control device 9.

Figure 3:
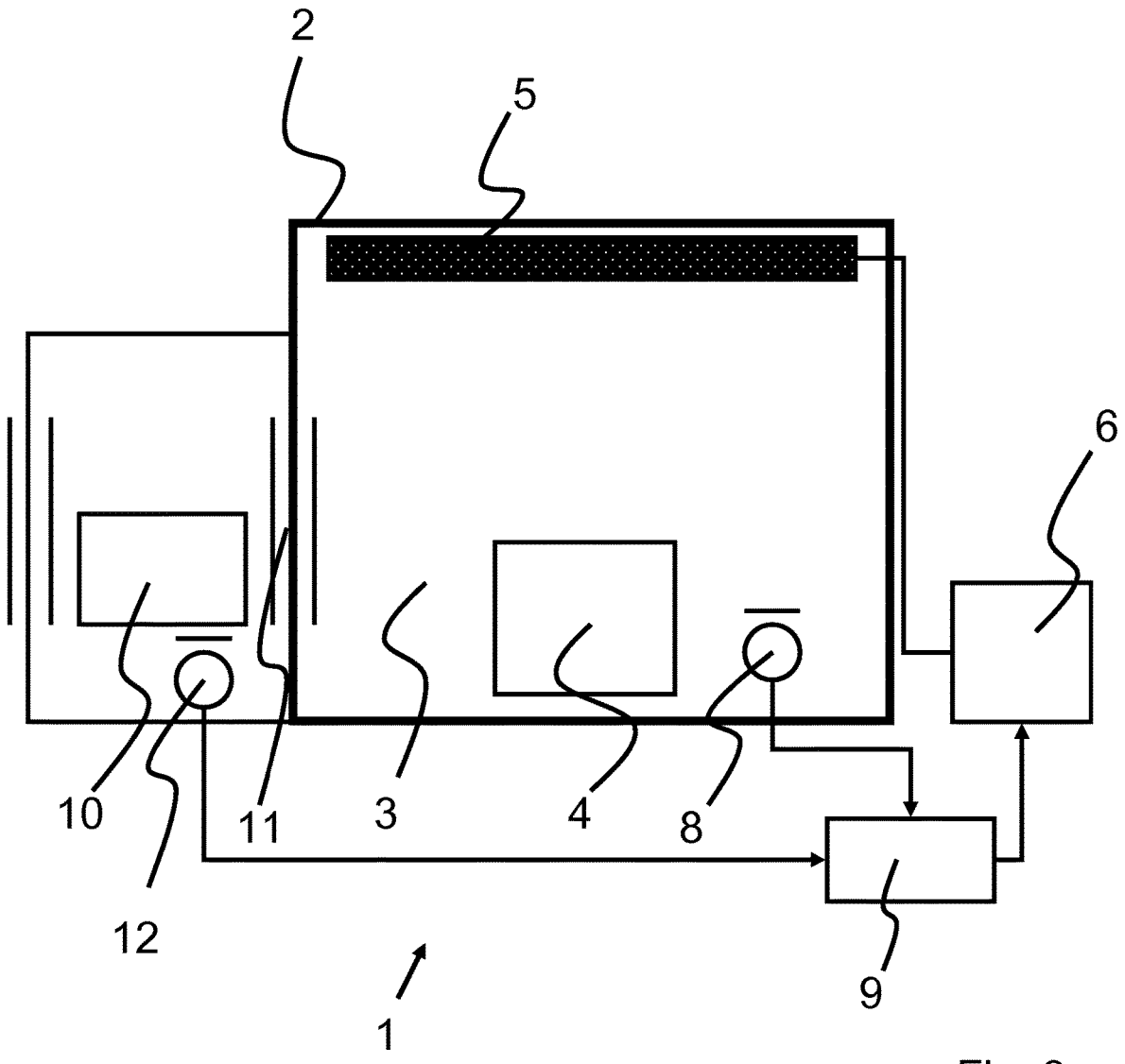
FIG. 3 shows a schematic view of a further alternative embodiment of an environmental noise shielding apparatus.

A further embodiment of an environmental noise shielding apparatus will be explained in more detail with reference to FIG. 3. In this embodiment, the housing 2 of the environmental noise shielding apparatus 1 is coupled to a sample transport apparatus 10. The sample transport apparatus 1 can be used to introduce samples (not illustrated) into the area 3 in the environmental noise shielding apparatus 1 via an automatic door 11, and feed said samples to the appliance 4 to be isolated.

A sensor 8 is arranged in the area 3 in the environmental noise shielding apparatus 1, and is connected to a control device 9.

A further sensor 12 is arranged outside the housing 2. The external temperature is measured using this sensor 12.

The control device 9 drives the supply device which is connected to the cooling element 5. The control device 9 is in this case designed such that it matches the temperature in the area 3 in the environmental noise shielding apparatus 1 to the external temperature, which is measured by the sensor 12.

Figure 4:
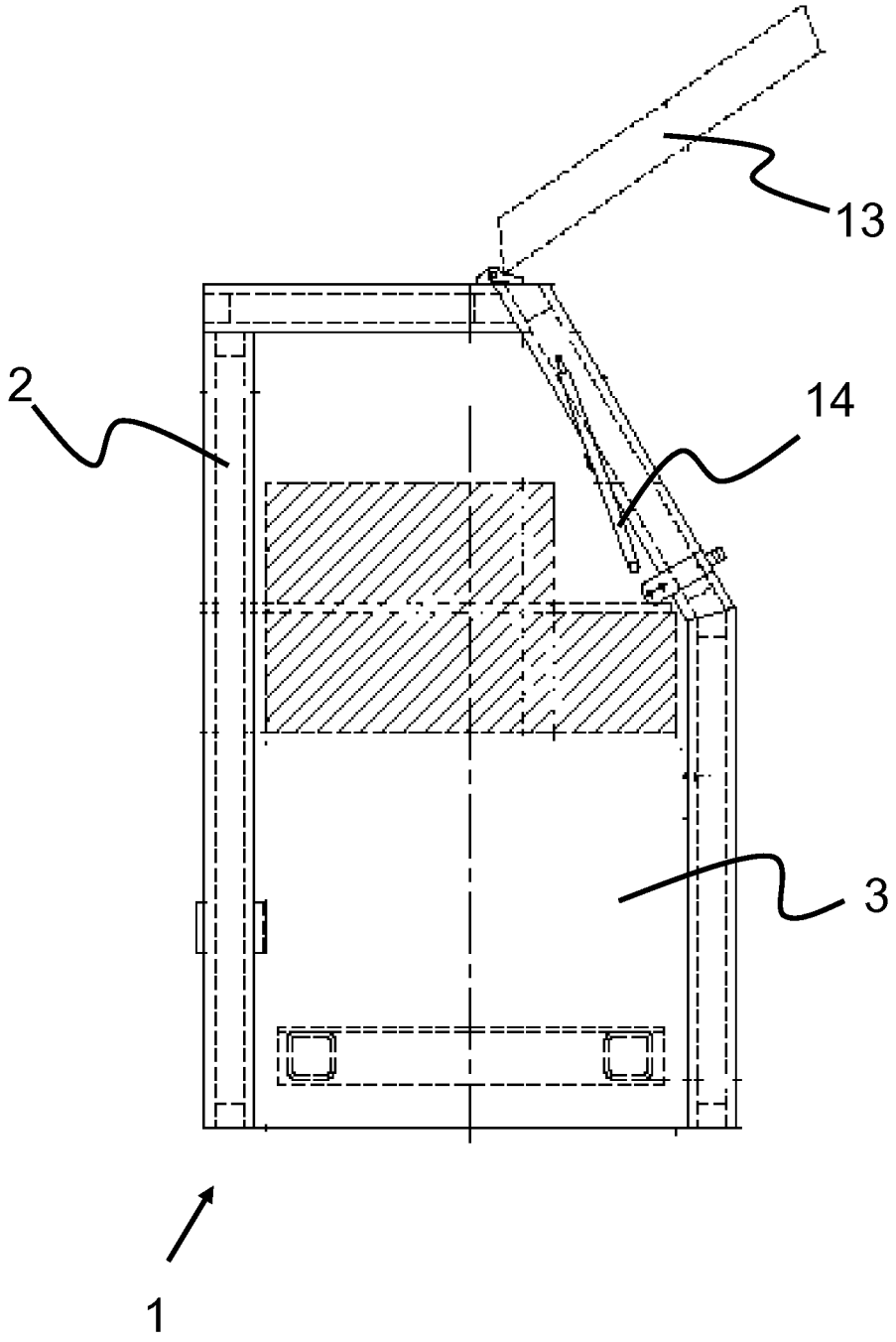
FIG. 4 shows a schematic illustration, with reference to which the housing of an environmental noise shielding apparatus will be explained.

The major components of a housing 2 of a further embodiment of an environmental noise shielding apparatus 1 will be explained in more detail with reference to FIG. 4. The housing 2 has a flap 13, which is held against the housing 2 via gas springs 14. The area 3 in the housing 2 can be closed to be essentially airtight, by means of the flap 13.

Figure 5:
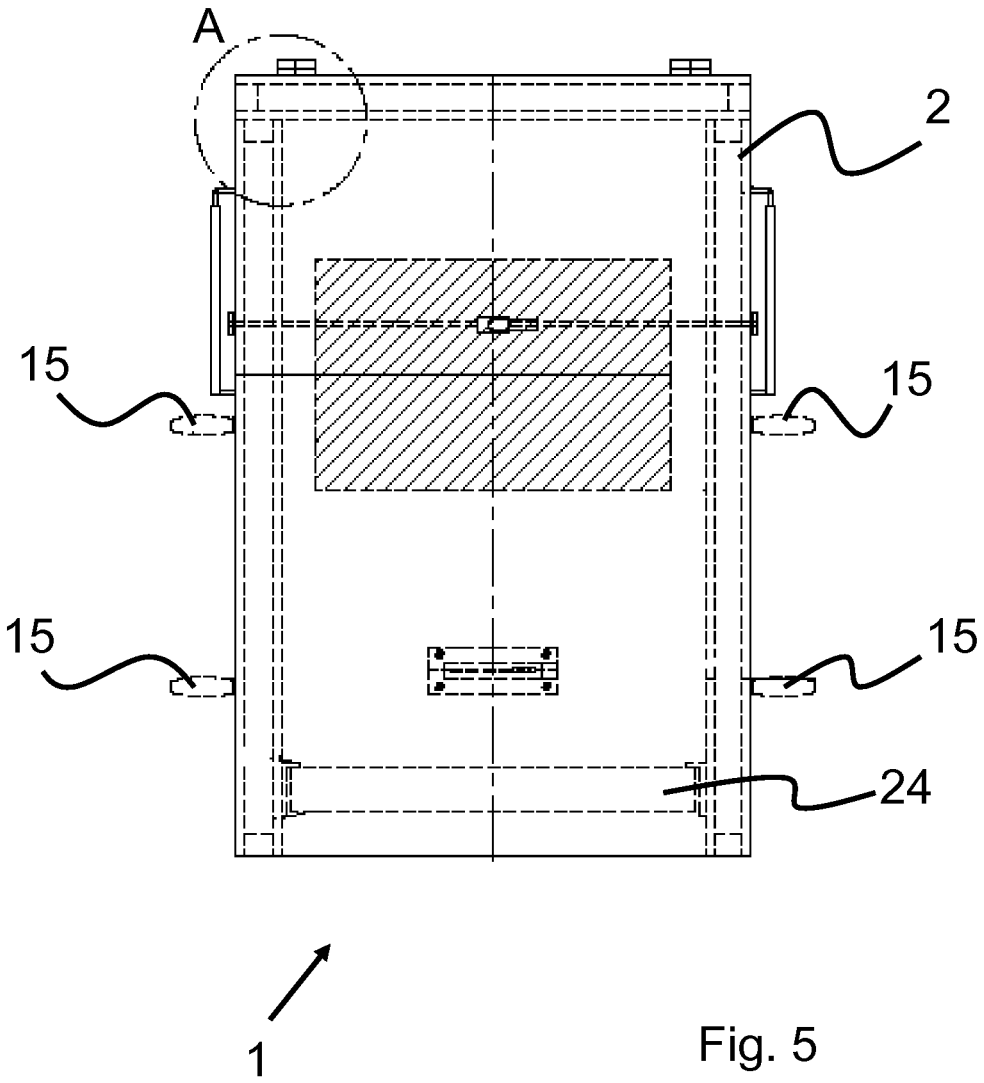
FIG. 5 shows a further view of an environmental noise shielding apparatus according to the invention.

FIG. 5 shows a further view of the housing 2 of the environmental noise shielding apparatus 1. Removable handles 15 are fitted to the housing 2, and can be used to carry the environmental noise shielding apparatus.

Furthermore, the environmental noise shielding apparatus 1 has a receptacle 24 for lifting it, for example by means of a fork lift truck. The receptacle 24 is also designed to be removable.

Figure 6:
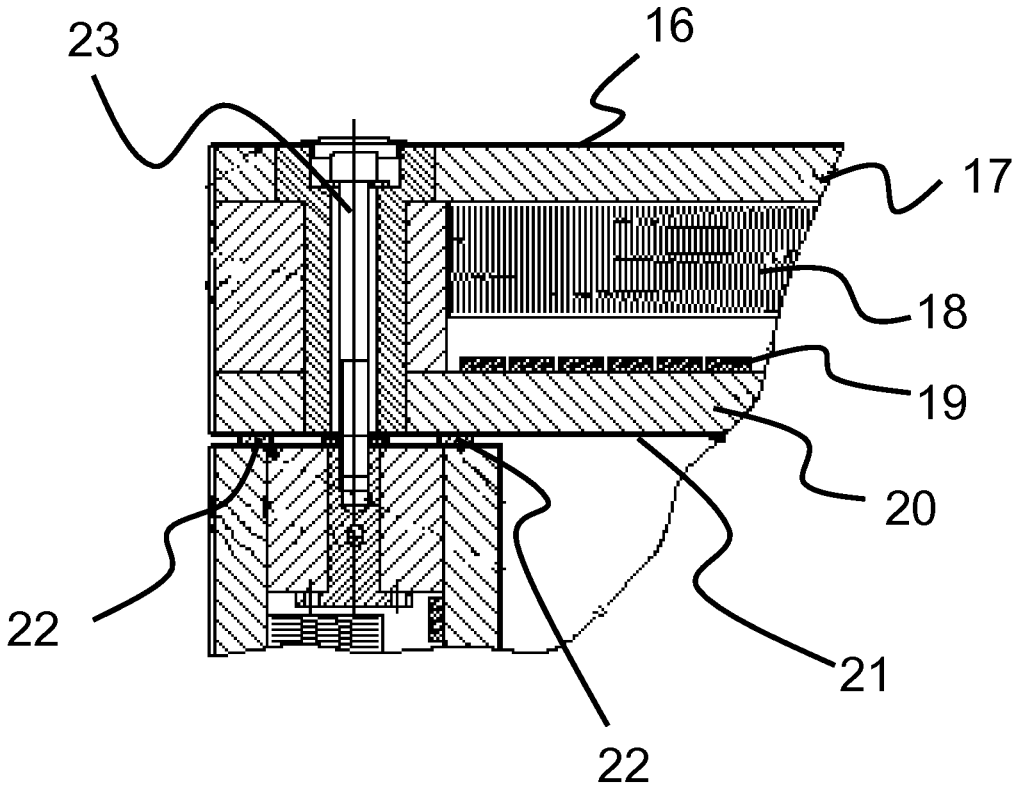
FIG. 6 shows a detailed illustration of the area A in FIG. 5.

FIG. 6 shows a detailed illustration of the area A in FIG. 5. The design of the housing will be explained in more detail with reference to the detailed illustration. The housing walls are formed from multiple layers of a composite material. In this exemplary embodiment, the walls have an outer laminate film 16, which is adhesively bonded to a piece of chipboard 17. Insulation in the form of mineral wool 18 is located behind the chipboard. A sound attenuating mat 19 is adhesively bonded to a further piece of chipboard 20 in the adjacent cavity. The sound attenuating mat 19 is filled with scrap steel. A film 21 is likewise adhesively bonded to the further piece of chipboard 20. The wall elements are connected to one another by means of screws 23. Seals 22, in this case in the form of silicone seals, are located between the individual wall elements, for noise shielding and to ensure that the housing is fluidtight.

It is self-evident that the invention is not restricted to a combination of the features described above and, instead, a person skilled in the art can combine all of the described features, where worthwhile.

What is claimed is:

1. A vibration isolation system, comprising an environmental noise shielding apparatus comprising:

a housing defining a space inside the housing, wherein the housing holds a semiconductor inspection appliance to be isolated, and wherein the housing is substantially fluid tight, so that air flow and, as a consequence, sound propagation between the space defined inside the housing and an environmental space outside the housing is prevented, the housing thus shielding the appliance against environmental sound; and the appliance and a cooling element arranged in the space defined inside the fluid tight housing, the cooling element being designed as a compressor cooling element, Peltier element, or cooling meander circuit;

wherein the environmental noise shielding apparatus has an opening flap;

wherein a supply apparatus is provided for the cooling element, with the supply device being arranged outside of the housing; and wherein walls of the housing are formed from multiple layers of a composite material.

2. The vibration isolation system as claimed in claim 1, wherein the supply device is connected to the cooling element by means of flexible lines or cables.

3. The vibration isolation system as claimed in claim 1, wherein the cooling element produces a sound level of less than 30 dB in the housing.

4. The vibration isolation system as claimed in claim 1, wherein the cooling element is integrated in a wall or a lid of the housing.

5. The vibration isolation system as claimed in claim 1, wherein at least one temperature sensor, which is designed to regulate a supply device for the cooling element, is arranged in the space.

6. The vibration isolation system as claimed in claim 1, wherein at least one temperature sensor is arranged outside the space.

7. The vibration isolation system as claimed in claim 1, wherein the opening flap is operable automatically.

8. The vibration isolation system as claimed in claim 1, wherein the opening flap closes to make the space essentially airtight.

9. The vibration isolation system as claimed in claim 1, wherein the space has a size of between 0.2 and 7 $m^3$.

10. The vibration isolation system as claimed in claim 1, wherein the sound attenuation from the outside inward with an incidence angle running essentially at right angles to a wall of the housing and of a frequency of 500 Hz is more than 5 dB.

11. A vibration isolation system, comprising:

a) at least one environmental noise shielding apparatus comprising (1) a fluid tight and noise shielding housing for i) defining a space for holding a semiconductor inspection appliance to be isolated and ii) shielding the appliance against environmental sound, and (2) at least one cooling element arranged in the space and at least one semiconductor inspection appliance arranged in the space, the cooling element being designed as a compressor cooling element, Peltier element, or cooling meander circuit; and wherein the environmental noise shielding apparatus has an opening flap;

wherein a supply apparatus is provided for the cooling element, with the supply device being arranged outside of the housing;

wherein the supply device is connected to the cooling element by flexible lines or cables; and wherein the cooling element produces a sound level of less than 30 dB in the housing.

12. A method for shielding against environmental sound, comprising:

providing a semiconductor inspection appliance;

introducing the semiconductor inspection appliance to be shielded through an opening flap into a fluid tight and noise shielding housing which provides shielding of the appliance against environmental sound;

closing the housing; and regulating a cooling apparatus which is arranged in the housing by a sensor which is arranged in the housing, the cooling element being designed as a compressor cooling element, Peltier element, or cooling meander circuit, wherein a supply device is arranged outside of the housing and connected to the cooling element by means of flexible lines or cables, wherein the environmental noise shielding apparatus has the opening flap, and wherein the opening flap is held against the housing via gas springs.

13. The method as claimed in claim 12, further comprising measuring both the temperature in the housing and the temperature outside the housing, wherein the temperature in the housing is essentially matched to the temperature outside the housing by the regulating of the cooling apparatus.

* * * * *